US007380349B2

(12) United States Patent
Ritter et al.

(10) Patent No.: US 7,380,349 B2
(45) Date of Patent: Jun. 3, 2008

(54) NOVELTY FOOTWEAR AND METHOD OF USING SAME

(75) Inventors: Brett D. Ritter, Del Mar, CA (US); Ryan Keenan, San Diego, CA (US); John Eades, San Diego, CA (US); Joel Barrie, Cardiff, CA (US); Nick Mann, San Marcos, CA (US); Andy Wickstrom, Pacific Beach, CA (US); Will Goloveyko, San Diego, CA (US)

(73) Assignee: South Cone, Inc.

( * ) Notice: Subject to any disclaimer, the term of this patent is extended or adjusted under 35 U.S.C. 154(b) by 251 days.

(21) Appl. No.: 10/971,187

(22) Filed: Oct. 22, 2004

(65) Prior Publication Data

US 2006/0086007 A1 Apr. 27, 2006

(51) Int. Cl.
*A43B 23/00* (2006.01)

(52) U.S. Cl. ..... 36/1; 36/136

(58) Field of Classification Search ..... 36/1, 36/136, 25 R, 107, 108; 81/3.09
See application file for complete search history.

(56) References Cited

U.S. PATENT DOCUMENTS

| | | | | |
|---|---|---|---|---|
| 2,608,889 | A | 9/1952 | Krupin | |
| D172,571 | S | 7/1954 | Ward | |
| 2,861,339 | A | 11/1958 | Malecki | |
| 2,996,938 | A * | 8/1961 | Holtzclaw et al. | 81/3.09 |
| 3,346,971 | A * | 10/1967 | Kiwala | 36/136 |
| 4,335,814 | A | 6/1982 | Benning et al. | |
| 5,154,101 | A * | 10/1992 | Wolford et al. | 81/3.09 |
| 5,226,647 | A * | 7/1993 | Notarmuzi | 473/284 |
| 5,255,452 | A * | 10/1993 | Jackson et al. | 36/113 |
| D373,290 | S * | 9/1996 | Ballin | D7/536 |
| 5,645,500 | A * | 7/1997 | Borden | 473/408 |
| 6,004,229 | A * | 12/1999 | Fazekas | 473/406 |
| 6,094,844 | A * | 8/2000 | Potts | 36/136 |
| 6,732,397 | B2 * | 5/2004 | Thompson | 15/160 |
| 2003/0192206 | A1 * | 10/2003 | Ashton | 36/127 |
| 2003/0208868 | A1 * | 11/2003 | Thompson | 15/160 |
| 2004/0237350 | A1 * | 12/2004 | Latham et al. | 36/127 |

* cited by examiner

*Primary Examiner*—Marie Patterson
(74) *Attorney, Agent, or Firm*—Jerry R. Potts

(57) ABSTRACT

A novelty footwear item includes an upper, a lower and an opener for protecting the foot of a user and for facilitating unsealing a sealed container with the footwear item.

24 Claims, 6 Drawing Sheets

NOVELTY FOOTWEAR AND METHOD OF USING SAME

FIELD OF THE INVENTION

This invention relates generally to novelty footwear and more particularly to a combination sandal and bottle cap opener and method of using the combination sandal and bottle cap opener for opening a sealed bottle.

BACKGROUND OF THE INVENTION

When wearing footwear at the beach, park or other places of outdoor relaxation and entertainment it-may be necessary to carry a bulky bottle cap opener if there is expected need to open bottles while in such venues. Therefore, it would be highly desirable to have a new and improved novelty footwear item and method of using such a footwear item to open a sealed bottle to eliminate the need to carry a bulky bottle cap opener.

SUMMARY OF THE INVENTION

A new and improved novelty footwear item includes a sandal having an upper and a bottom with a bottle cap opener disposed on either the upper or the bottom.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings wherein.

DETAILED DESCRIPTION OF PREFERRED EMBODIMENTS

Figure 1:
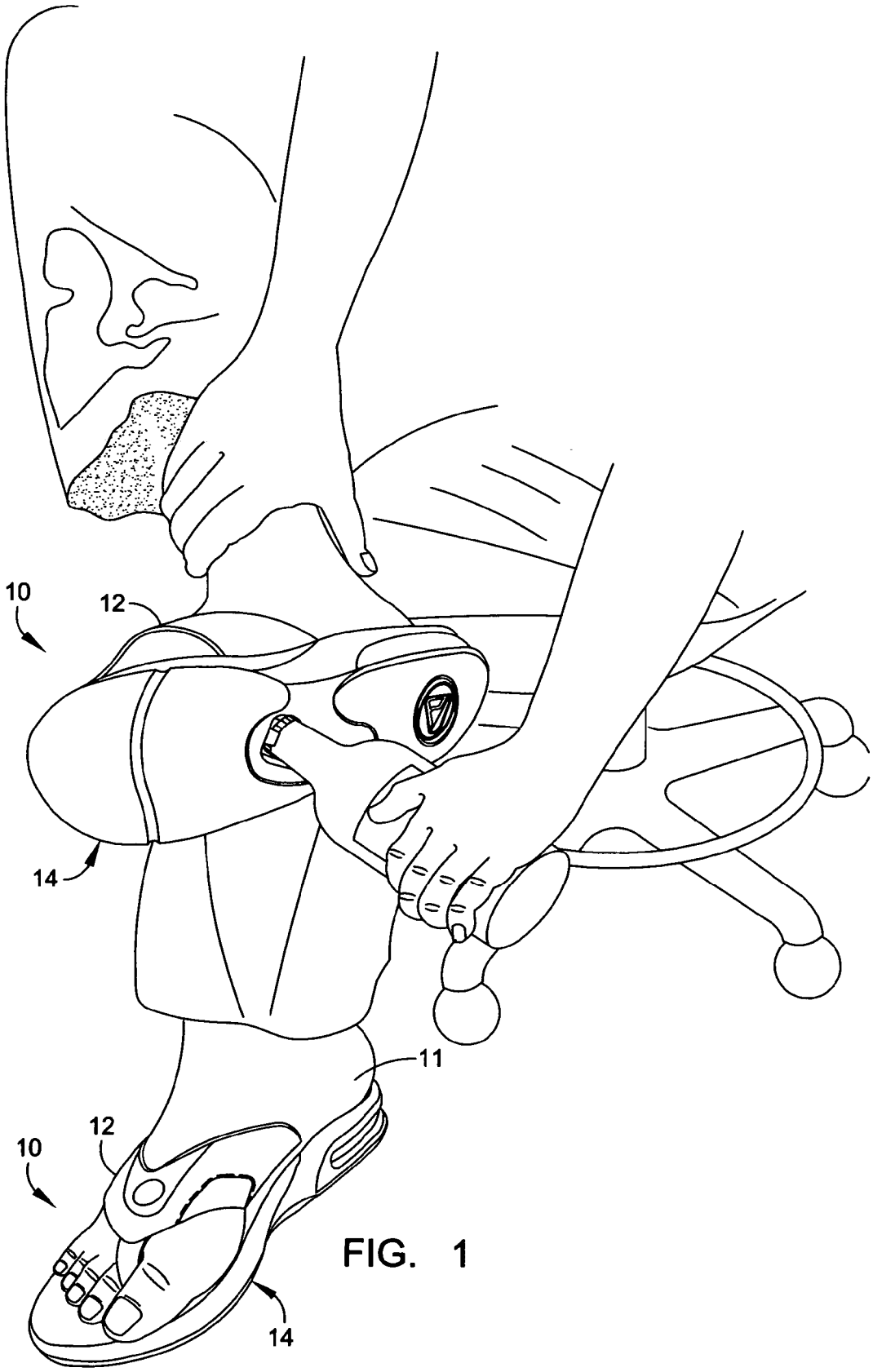
FIG. 1 is a pictorial view of a novelty footwear item, which is constructed in accordance with the present invention.

Referring now to the drawings and more particularly to FIGS. 18 there is shown an illustrative preferred embodiment of a novelty footwear item 10, which is constructed in accordance with the present invention. The novelty footwear item 10 when used in accordance with a novel method of using the footwear item 10 not only protects and supports the foot of a user but also enables a user 11 to easily and conveniently open a bottle B having sealing cap C.

Considering now the novelty footwear item 10 in greater detail with reference to FIGS. 1-8, the novelty footwear item 10 generally comprises an upper or strap assembly 12 and a bottom or foot-shaped sole assembly 14 which is held to the foot of the user 11 by the strap assembly 12. The upper 12 and bottom 14 in combination provide an attractive fashion wear appearance.

Figure 2:
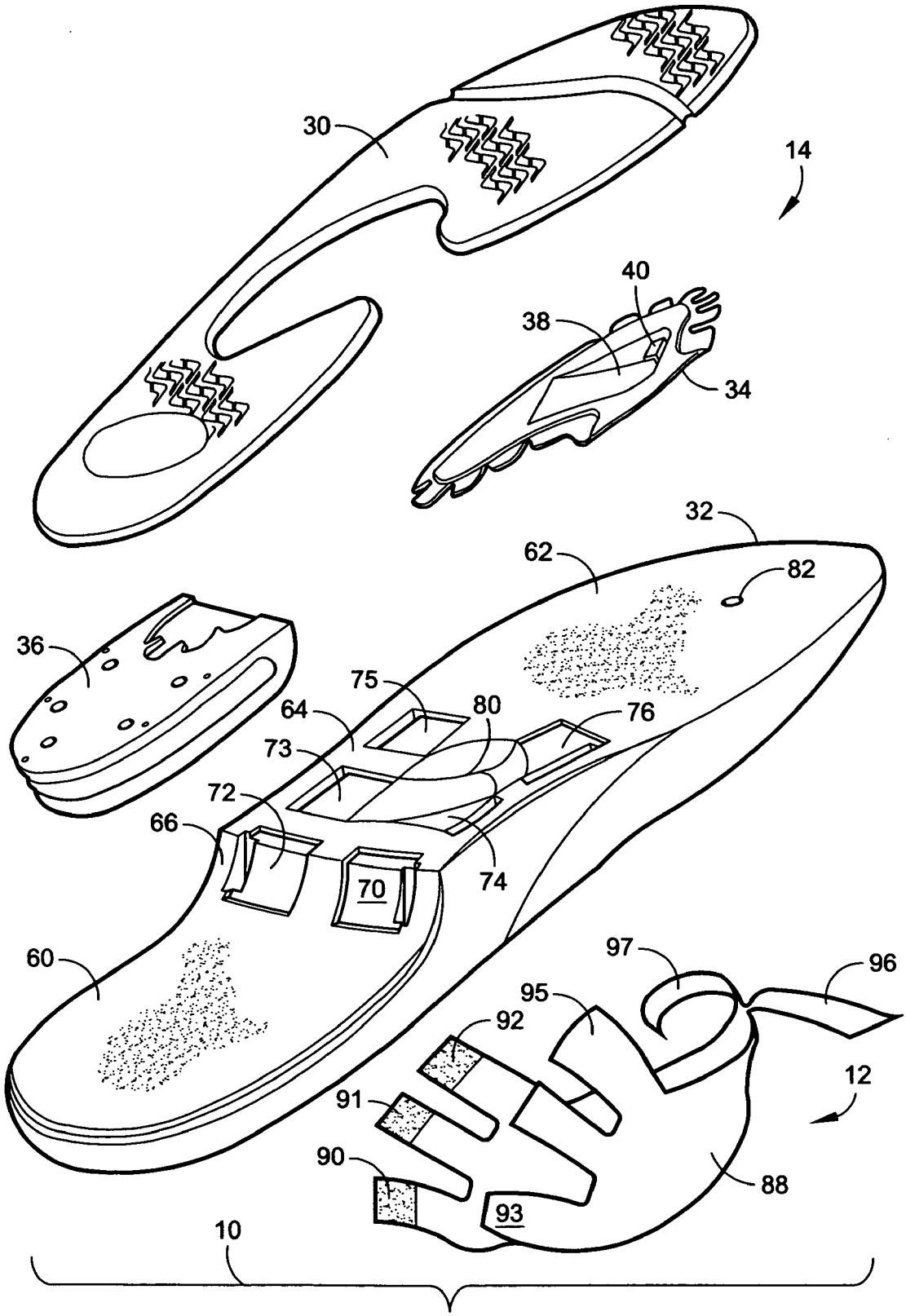
FIG. 2 is an enlarged exploded view of the novelty footwear item of FIG. 1.

Considering now the strap assembly 12 in greater detail with reference to FIG. 2, the strap assembly 12 has a unitary construction which generally includes a foot or main body strap 88 having a plurality of integrally connected rear anchoring straps 90-95 and a plurality of integrally connected front anchoring straps 96-97. The rear and front anchoring straps 90-95 and 96-97 respectively, are flexible narrow fingers which extend outwardly from the main body strap 88, and are all configured to be adhesively secured to the sole assembly 14. The strap assembly 12 is composed of a soft pliable material, which is configured to hold the foot of the user 11 to the bottom 14 to facilitate protecting and supporting the foot of user 11.

Figure 3:
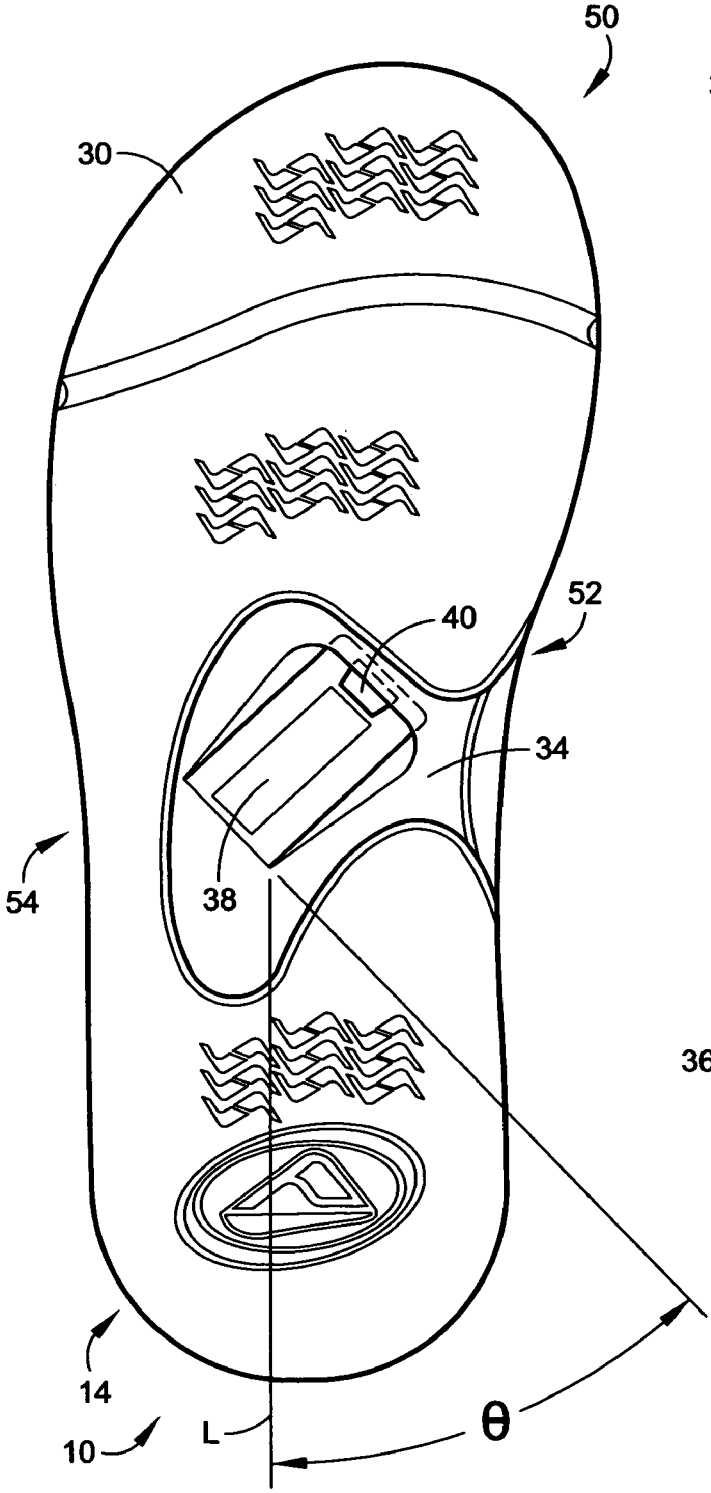
FIG. 3 is a bottom plan view of the bottom of the novelty footwear item of FIG. 1.
Figure 4:
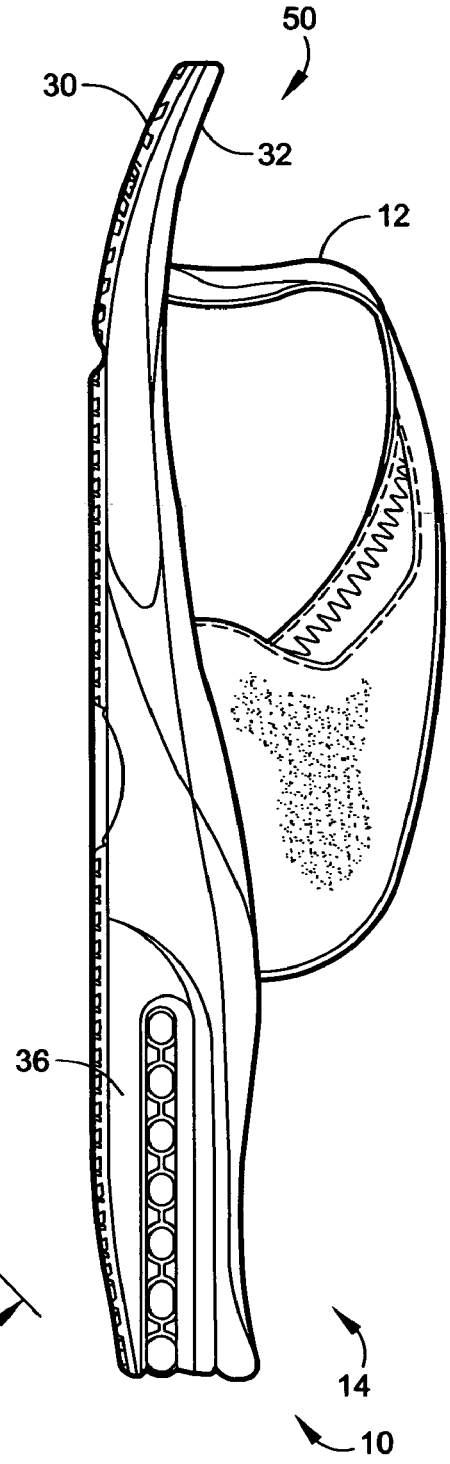
FIG. 4 is a side elevational view of the novelty footwear item of FIG. 1.
Figure 6:
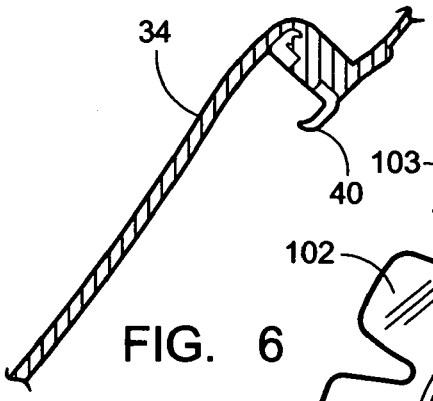
FIG. 6 is a cross-sectional view of the shank of FIG. 5 taken substantially along line 6-6.
Figure 5:
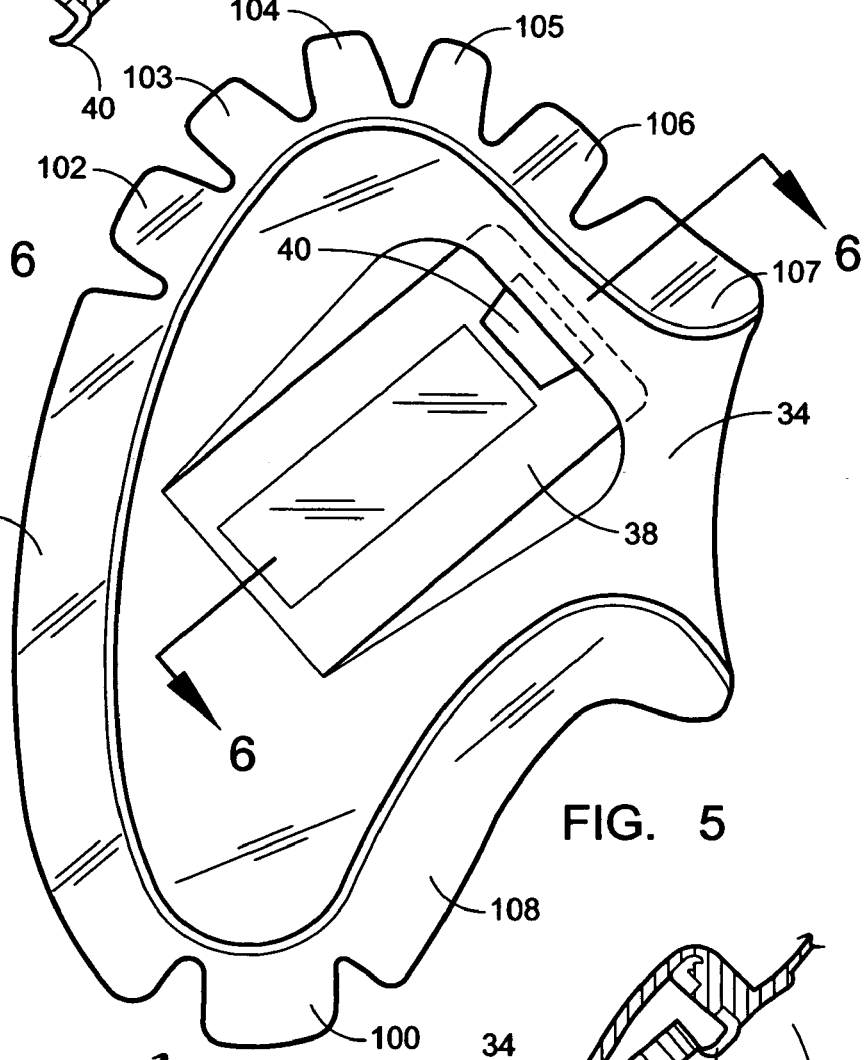
FIG. 5 is a plan view of the shank of the novelty footwear item of FIG. 1.

Considering now the sole assembly or bottom 14 in greater detail with reference to FIGS. 2-4, the sole assembly 14 generally includes an outer sole 30, a mid-sole 32, a shank 34 and a heel or airbag 36. The sole assembly 14 in plan view has a planar pattern that generally conforms to the outline of a human foot and functions to protect, cushion and support the foot of the user 11. When assembled the sole assembly 14 is lightweight and is configured in an attractive fashion wear ornamental design. In this regard, as best seen in FIGS. 3-4, the sole assembly 14 further includes a front or forefoot section indicated generally at 50, a medial side indicated generally at 52 and a lateral side indicated generally at 54.

The bottom or sole assembly 14 is designed to provide a resting platform for the foot of the user 11 so as to cushion and support the foot of the user 11. In addition, as will be explained hereinafter in greater detail, the sole assembly 14 includes a novelty item in the form of a bottle cap opener 40, which allows the user 11 to open the sealed bottle B with the footwear item 10.

Considering now the outer sole 30 in greater detail with reference to FIG. 2, the outer sole 30 is composed of a wide variety of flexible materials, such as rubber compounds, thermoplastic, thermosetting polymer compounds, foam polyurethane plastic, foam rubber and ethylene vinyl acetate. A rubber compound is a preferred material, which is sufficiently durable to function over an extended period of time as a wear surface for engaging the ground and providing the footwear 10 with the ability to grip and maintain traction with the ground.

Also since the bottom surface of the outer sole 30 is highly visible, the bottom surface as best seen in FIG. 3 bears a unique non-skid stylized pattern which functions to prevent the footwear item 10 from slipping on the ground, to provide the footwear item 10 with traction and to provide the outer sole with an attractive appearance. As will be explained hereinafter in greater detail, the outer sole 30 also functions for facilitating transferring the dynamic energy imparted by the user to the footwear item 10 into controlled motion in a user desired and selected direction.

Considering now the mid-sole 32 in greater detail with reference to FIG. 2, the mid-sole 32 provides a platform for the foot of a user and a base support for the strap 12, the outer sole 30, the shank 34 and the airbag 36 as will be explained hereinafter in greater detail. The mid-sole 32, like the outer sole may be composed of a wide variety of flexible materials, such as thermoplastic, thermosetting polymer compounds, foam polyurethane plastic or foam rubber. Ethylene vinyl acetate ("EVA") foam is a preferred material. The hardness and density with a relatively soft cushioning consistency that facilitates foot comfort.

The mid-sole 32 generally includes a lower or heel portion indicated generally at 60 in FIG. 2, an upper or forefoot portion indicated generally at 62 and a mid-foot portion indicated generally at 64. A sloping wall 66 rising upward from the lower portion 60 to the mid-foot portion 64 includes a pair of slotted alignment cutout 70 and 72 respectively. Another set of slotted alignment cutouts 73-76 is disposed in the upper mid-foot portion 64 along with a non-slotted alignment cutout 80. As will be explained hereinafter in greater detail, the slotted cutouts 70, 72 and 73-76 are dimensioned for receiving therein individual ones of the anchor straps 90-95 through their respective slots during the assembly process. The non-slotted alignment cutout 80 is dimensioned and sufficiently recessed within the mid-sole 32 to receive therein the shank 34.

Considering now the shank 34 in greater detail with reference to FIGS. 1-8, the shank 34 has an irregular shape with a recess area 38 which is offset at about an angle 0 relative to a longitudinal line L as best seen in FIG. 3. An integrally formed bottle cap opener 40 is formed within the recessed area 38. The shank 34 includes a set of irregularly shaped fingers 100-109, which enhance the bonding of the shank 34 within the alignment cutout 80 of the mid-sole 32. The finger 100-109 also allow the dynamic energy developed by the user when walking on a solid surface to be transferred from the heel area to the forefoot area of the footwear item 10.

Figure 12:
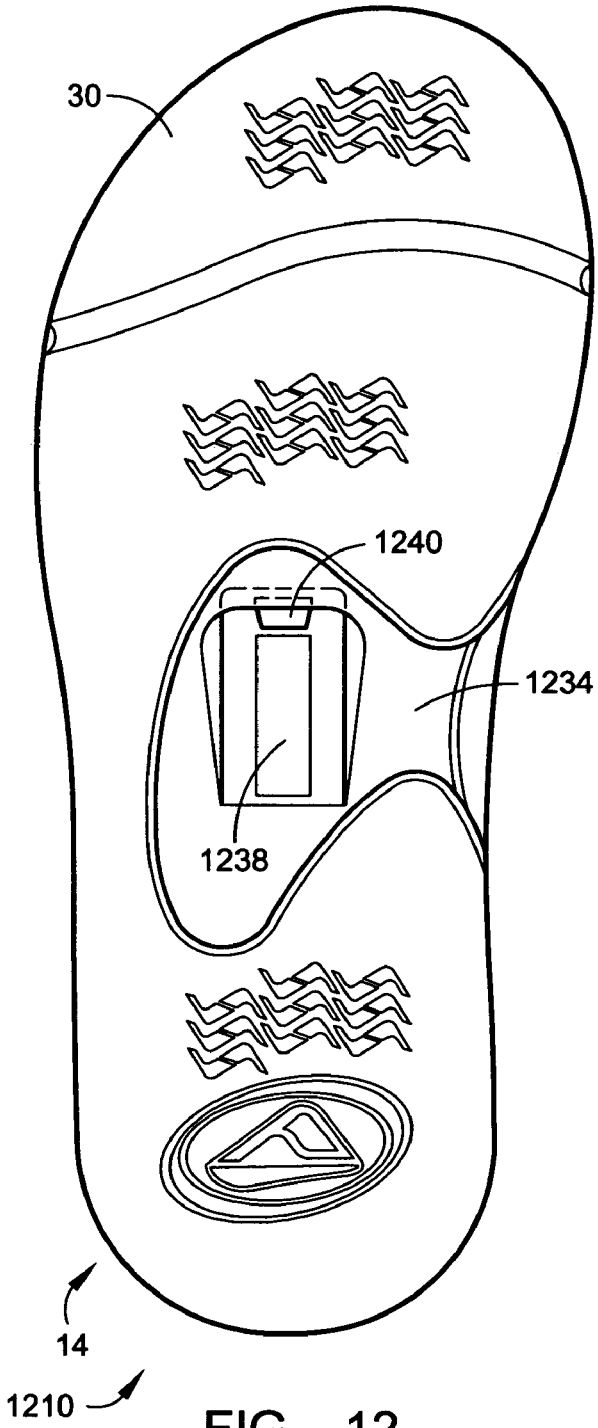
FIG. 12 is bottom plan view of yet another novelty footwear item, which is constructed in accordance with the present invention.
Figure 13:
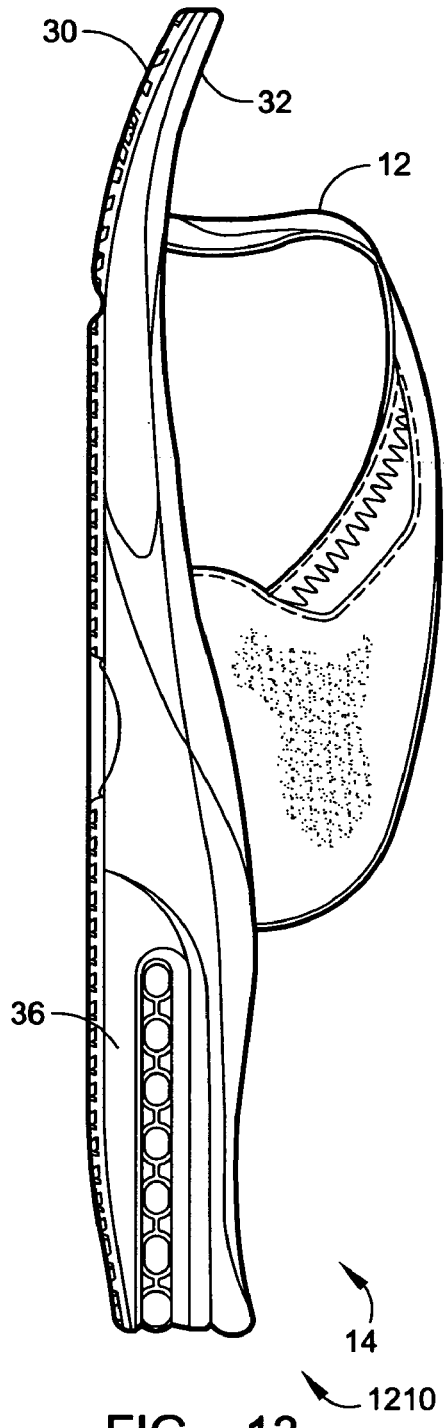
FIG. 13 is a side elevational view of the novelty footwear item of FIG. 12.

The angle θ at which the recess area 38 is disposed is an important feature of the present invention as this angle θ is chosen so that the bottle cap C when engaged with the bottle cap opener 40 will position the bottle B is a sufficiently upright manner so at to substantially prevent any liquid from within the bottle accidentally spilling. The angle θ is between about 0 degrees and about 90 degrees, and more preferably is between about 0 degrees and about 45 degrees. A most preferred angle θ is about 30 degrees. As an example of an angle θ at other than the preferred angle of about 30 degrees, reference may be made to a second embodiment 1210, as best seen in FIGS. 12-13 where a shank 1234 includes a recess 1238 with an open 1240 disposed at an angle θ of about 0 degrees.

Considering now the airbag or heel 36 in greater detail with reference to FIGS. 1-2, the heel 36 has an cutoff oval shape and a thickness dimension that is sufficient to provide the mid-sole 32 with a substantially flat bottom surface when the heel 36 is adhesively secured to the lower area 60 of the mid-sole. The flat bottom surface of the mid-sole 32 is a prepared surface that is adapted for receiving the outer sole 30. The outer sole 30 as best seen in FIGS. 2-4 overlays the mid-sole 32 and is adhesively secured to the mid-sole 32 by a suitable adhesive. As best seen in FIG. 3, a cut out area is provided in the outer sole 30 so there is free user access to the opener 40 as needed. It should be noted that the bottle open 40 is disposed within the recess area 38 and thus, the opener 40 does not scrap itself against ground surfaces nor does it extend out of the recess area to scrap and scuff delicate floor surfaces.

In the assembly process, the strap assembly 12 is first affixed to the mid-sole 32 by a suitable adhesive by passing the anchoring straps 90-95 and 96-97 through their respective strap alignment holes and then pressing and holding them into their respective alignment cutouts in engagement with the bottom surface of the mid-sole 32 for a sufficient period of time until they are securely bonded to the bottom surface of the mid-sole 32. In this regard, the anchor straps 90-95 are pulled upwardly to their maximum extension through their respective cutout slots, their mid-foot engaging surfaces are coated with a suitable adhesive and then they are pressed flat within their respective cutouts until they are securely bonded to the mid-foot surface. In a similar manner anchor straps 96-97 are pulled through their alignment hole 82, coated with a suitable adhesive and then pressed flat against the bottom surface of the mid-sole 32.

Next, the airbag 36 is affixed to the mid-sole 32 by coating its mid-sole engaging surface with an adhesive and then aligning the airbag 36 within the lower area 60 of the mid-sole 32 by pressing and holding the proximal end of the airbag 36 against the wall 66 and overlying the anchoring straps 90 and 93 respectively, which had been previously adhered to the mid-sole 32.

Next the bottom surface of the shank 34 is coated with an adhesive and then press fit into its alignment cutout 80 until is secured to the bottom of the mid-sole 32.

As a final assembly step, the under surface of the outer sole 30 is coated with an adhesive and then laid over the mid-sole 30, the airbag 36 and about the shank 34 and pressed down until the outer sole is secured in place.

Figure 7:
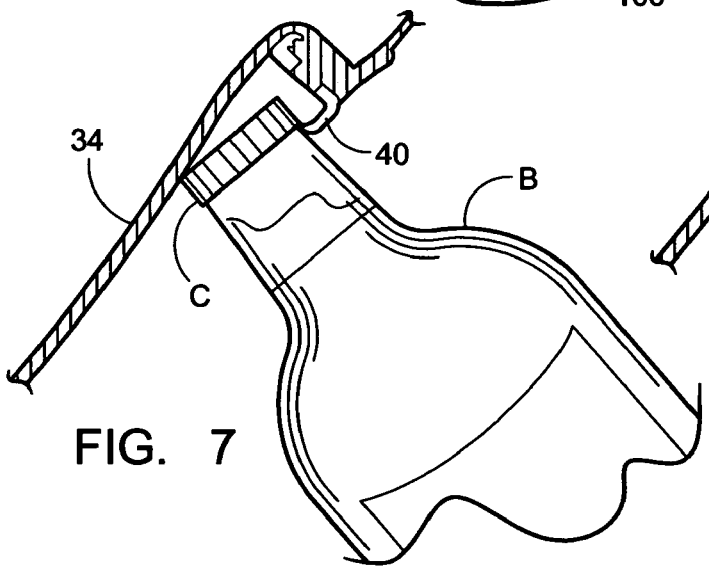
FIG. 7 is a cross-sectional view of the shank of FIG. 5, illustrating its alignment with a sealed bottle and an associated bottle cap.
Figure 8:
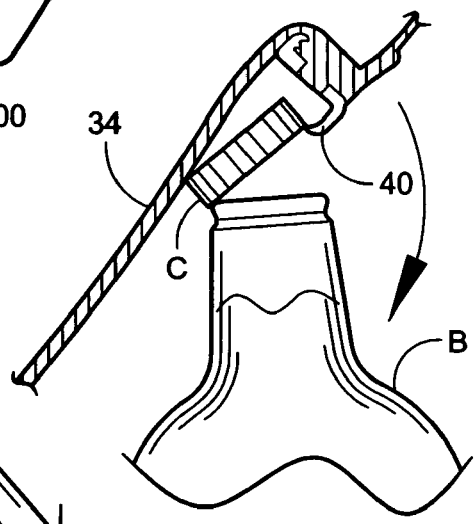
FIG. 8 is a cross-sectional view of the shank of FIG. 5, illustrating the relative movement of the bottle and the shank to cause the associated bottle cap to be removed from the bottle.

Considering now the method of using the novelty footwear item 10 in greater detail with reference to FIGS. 1 and 6-8, a user wearing the novelty footwear item 10 rests his or her ankle on his or her upper thigh as best seen in FIG. 1 to expose the bottom surface of the footwear item 10. In this regard, it should be noted that the opener 40 is disposed at such an angle to allow the user to engage a sealing cap as seen in FIG. 7 and then pull the bottle down and away from the opener 40 thereby causing the cap C to be removed as seen in FIG. 8. The orientation of the opener 40 relative to receiving a bottle cap C is sufficiently perpendicular to the ground to prevent the fluid disposed with the bottle B from spilling when the cap C is removed.

Figure 9:
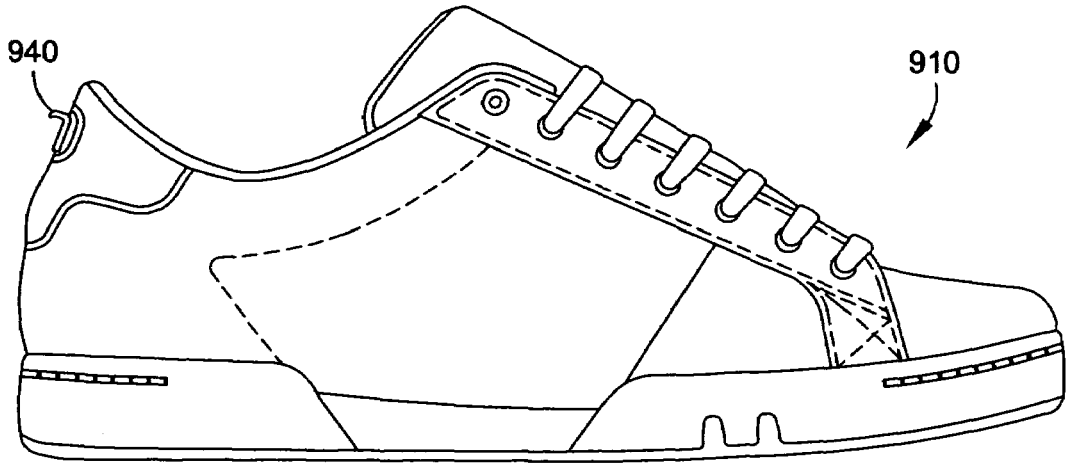
FIG. 9 is a side elevational view of another novelty footwear item, which is constructed in accordance with the present invention.
Figure 10:
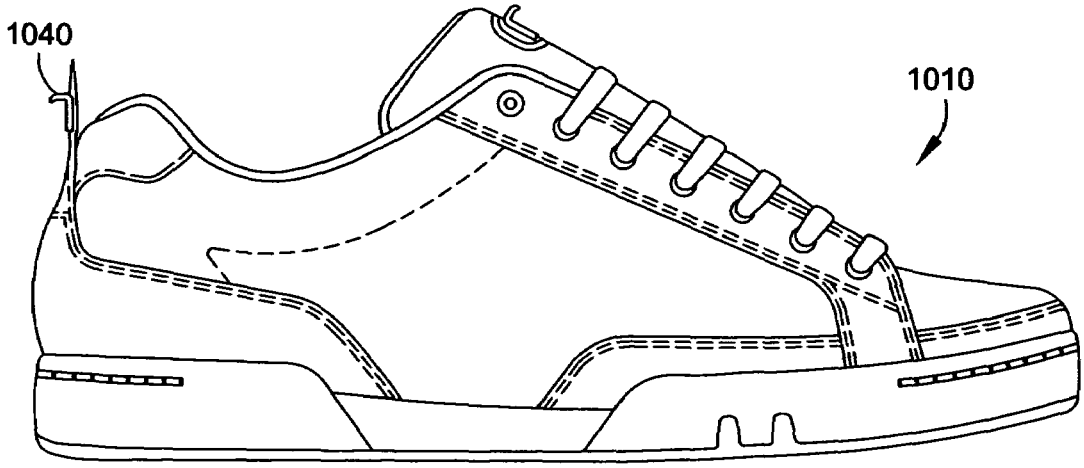
FIG. 10 is a side elevational view of another novelty footwear item, which is constructed in accordance with the present invention.
Figure 11:
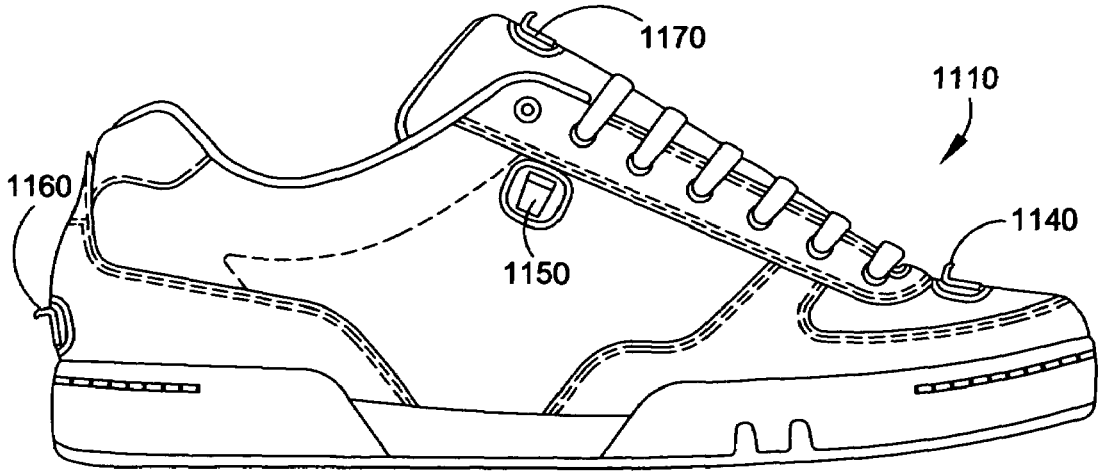
FIG. 11 is a side elevational view of another novelty footwear item, which is constructed in accordance with the present invention.

It is evident that there are additional embodiments and applications of the improved sandal which are not disclosed in this detailed description, but which would clearly fall with the scope of said invention. For example, as best seen in FIG. 9-11 it can be seen that an opener may be disposed in different locations on the footwear and that the opener may be disposed on many different types of footwear, such as shoes, boots, and sandals. In this regard, in FIG. 9, an opener 940 is shown disposed on the back tab of a shoe 910. As another example, in FIG. 10, an opener 1040 is shown extending form the heel fixing of a shoe 1010. As yet another example, in FIG. 11 a plurality of openers 1140, 1150, 1160 and 1170 are shown disposed on the vamp, the quarter, the heel stabilizer, and the tongue of a shoe, such as shoes 910, 1010, and 1110 for example. Based on the foregoing, this specification is intended therefore to illustrate and clarify the nature of this invention and not limit its scope.

We claim:

1. A novelty construction, comprising:

a footwear item for supporting the foot of a user;

an opener disposed on said footwear item;

wherein said footwear item includes:

a lower having a recessed area disposed on a lower surface thereof; and a shank disposed within said recessed area, said shank having a unitary construction including an integrally formed bottle cap opener and an integrally formed recess dimensioned to be received within said recessed area of said lower; and wherein said integrally formed bottle cap opener extends outwardly into said integrally formed recess a sufficient distance to facilitate the capture of a bottle cap on a sealed bottle.

2. The novelty construction according to claim 1, wherein said lower is a foot-shaped sole assembly having an upper surface and a lower surface.

3. The novelty construction according to claim 2, wherein the novelty footwear item has a longitudinal axis.

4. The novelty construction according to claim 3, wherein said cap opener is disposed at about an angle θ relative to the longitudinal axis of the novelty construction.

5. The novelty footwear item according to claim 3, wherein said angle θ is between about 0 degrees and about 90 degrees relative to the longitudinal axis of the novelty construction.

6. The novelty footwear item according to claim 5, wherein said angle θ is preferably between about 0 degrees and about 45 degrees relative to the longitudinal axis of the novelty construction.

7. The novelty footwear item according to claim 6, wherein said angle θ is most preferably at about 30 degrees relative to the longitudinal axis of the novelty construction.

8. A novelty footwear item, comprising:

a foot-shaped sole assembly having an upper surface and a lower surface; and a bottle cap opener disposed within said lower surface for facilitating unsealing a sealed container;

wherein said foot-shaped sole assembly includes a shank disposed on and within said lower surface; and wherein said shank includes a recess having said opener disposed therein.

9. The novelty footwear item according to claim 8, wherein said foot-shaped sole assembly forms part of a shoe.

10. The novelty construction according to claim 9, wherein said footwear item includes a vamp and wherein said opener is disposed on said vamp.

11. The novelty construction according to claim 9, wherein said footwear item includes a backtab and wherein said opener is disposed on said backtab.

12. The novelty construction according to claim 9, wherein said footwear item includes a heel stabilizer and wherein said opener is disposed on said heel stabilizer.

13. The novelty construction according to claim 9, wherein said footwear item includes a quarter and wherein said opener is disposed on said quarter.

14. The novelty construction according to claim 9, wherein said footwear item includes a heel fixing and wherein said opener is disposed on said heel fixing.

15. The novelty construction according to claim 9, wherein said footwear item includes a back tab and wherein said opener extends upwardly from said backtab.

16. A novelty footwear item, comprising:

an outer sole having a front portion and a rear portion;

a mid-sole having a cutout disposed therein at about between said front portion and said rear portion;

a shank mounted within said cutout, said shank having a unitary construction with an integrally formed recess and bottle cap opener; and wherein said integrally formed bottle cap opener extends outwardly into said integrally formed recess a sufficient distance to facilitate the capture of a bottle cap on a sealed bottle.

17. The novelty footwear item according to claim 16, wherein said recess is offset within said shank at about an angle θ relative to a longitudinal axis of said longitudinal axts of said mid-sole.

18. The novelty footwear item according to claim 17, wherein said bottle cap opener is offset within said shank at about said angle θ relative to a longitudinal axis of said mid-sole.

19. The novelty footwear item according to claim 16, wherein said shank includes a set of irregularly shaped fingers for facilitating bonding of said shank within said cutout.

20. The novelty footwear item according to claim 18, wherein said bottle cap opener is generally U-shaped.

21. The novelty footwear item according to claim 20, wherein said angle θ is most preferably at about 30 degrees relative to the longitudinal axis of the novelty footwear item.

22. The novelty footwear item according to claim 21, further comprising:

a heel sandwiched between said outer sole and said midsole at about said rear portion of said outer sole.

23. The novelty footwear item according to claim 22, wherein said footwear construction is a sandal construction.

24. The novelty footwear item according to claim 22, wherein said footwear construction is a shoe construction.

* * * * *